US006461252B1

(12) United States Patent
Yamagishi et al.

(10) Patent No.: US 6,461,252 B1
(45) Date of Patent: Oct. 8, 2002

(54) SOLID GOLF BALL

(75) Inventors: Hisashi Yamagishi; Hiroshi Higuchi; Yasushi Ichikawa; Junji Hayashi, all of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/124,362

(22) Filed: Jul. 29, 1998

(30) Foreign Application Priority Data

Jul. 30, 1997 (JP) ..... 9-219283

(51) Int. Cl.[7] ..... A63B 37/12
(52) U.S. Cl. ..... 473/378; 473/371
(58) Field of Search ..... 473/378, 374, 473/373, 377, 370, 371, 376

(56) References Cited

U.S. PATENT DOCUMENTS 5,184,828 A * 2/1993 Kim et al. ..... 473/374
5,497,996 A * 3/1996 Cadorniga ..... 473/378 X
5,688,191 A * 11/1997 Cavallaro ..... 473/378 X
5,688,595 A * 11/1997 Yamagishi et al. ..... 473/378 X
6,220,972 B1 * 4/2001 Sullivan et al. ..... 473/374

FOREIGN PATENT DOCUMENTS

| | | |
|---|---|---|
| GB | 2 316 328 A | 2/1998 |
| GB | 2 321 021 A | 7/1998 |
| JP | B 4110/1995 | 10/1983 |
| JP | B 8301/1995 | 5/1986 |
| JP | A 24084/1995 | 7/1993 |
| JP | A 24085/1995 | 7/1993 |
| JP | A 10358/1997 | 6/1995 |

* cited by examiner

*Primary Examiner*—Sam Rimell
(74) *Attorney, Agent, or Firm*—Sughrue Mion, PLLC

(57) ABSTRACT

In a solid golf ball comprising a solid core, a cover inner layer and a cover outer layer, the cover inner layer is composed mainly of a thermoplastic elastomer free of an ionomer resin, and the cover outer layer contains 50–100% by weight of an ionomer resin. The difference in Shore D hardness between the inner and outer layers is within 2 Shore units. While maintaining superior flight performance and durability, the inventive ball has spin receptivity close to wound golf balls.

10 Claims, 1 Drawing Sheet

SOLID GOLF BALL

BACKGROUND OF THE INVENTION

1. Field of the Invention

This invention relates to a solid golf ball comprising a solid core and a two-layer cover it relates to particularly, such a golf ball which is improved in spin receptivity, feel and control at no sacrifice of flight performance and durability.

2. Prior Art

Golf balls having a variety of constructions are available today on the market. The majority of commercial golf balls are either two-piece solid golf balls comprising a rubber-based core and a cover composed of ionomer resin or the like, or thread-wound golf balls comprising a thread-wound core obtained by winding rubber thread about a solid or liquid center, and a cover: formed over the core.

Most golfers of ordinaryl skill use two-piece solid golf balls because of their excellent flight performance and durability. However, these balls have a very hard feel and are poor in control due to the rapid separation of the ball from the club head. For this reason, many professional golfers and skilled amateurs prefer using thread-wound balls to two-piece solid balls. Yet, although thread-wound golf balls have a superior feel and control, their distance and durability fall short of those for two-piece balls.

Thus, two-piece solid golf balls and thread-wound golf balls today provide mutually opposing features, and so golfers select which type of b,all to use based on their level of skill and personal preference.

In order to produce solid golf balls presenting a feel close to that of wound golf balls when hit, the inventors made a number of proposals about three-piece solid golf balls comprising a solid core, a cover inner layer and a cover outer layer, as disclosed in JP-B 8301/1995, JP-A 24084/1995 and JP-A 10358/1997. These patents disclose golf balls wherein the cover outer layer is formed harder than the cover inner layer, and the balls are designed to acquire a lower spin rate upon shots intended for distance like driver shots.

These galls are advantageous in flight distance, but due to the low spin structure, they are difficult to stop when the player desires to stop the ball at the destination on an iron shot.

By contrast, many proposals were also made on golf balls which are improved in control, as disclosed in JP-B 4110/1993 and JP-A 24085/1995. These golf balls are characterized in that the cover inner layer is formed harder than the cover outer layer. It is intended to increase spin by softening the cover outer layer to increase the friction of the ball with the club face. Despite the advantage of increased spin, these golf balls, however, sometimes fail to increase the flight distance because of the soft cover outer layer inviting a loss of resilience.

SUMMARY OF THE INVENTION

Therefore, an object of the invention is to provide a solid golf ball which has spin receptivity close to wound golf balls, that is, receives an appropriate spin on iron shots, and is improved in control and feel, at no sacrifice of the superior flight performance and durability inherent to solid golf balls.

The invention is directed to a solid golf ball comprising a solid core formed of a base rubber and a cover of two-layer structure consisting of an inner layer surrounding the solid core and an outer layer surrounding the inner layer. According to the invention, the cover inner layer is composed mainly of a thermoplastic elastomer free of an ionomer resin, and the cover outer layer is formed of a cover stock containing 50 to 100% by weight of an ionomer resin. These cover layers are adjusted such that the difference in Shore D hardness between the inner layer and the outer layer is within 2 Shore units. Then, while maintaining the superior flight performance and durability inherent to solid golf balls, the ball is improved in feel and spin receptivity. The spin receptivity of the ball is increased to a level close to that of wound golf balls. Then the ball will receive an appropriate spin on iron shots. The ball thus becomes easier to control and pleasant to the feel.

In one preferred embodiment, the cover inner layer is formed such that the ratio of M400%/M100% is up to 1.9/1, wherein M100% is the strength :of the inner layer at a tensile elongation of 100% and M400% is the strength of the inner layer at a tensile elongation of 400%. Upon impacts with weaker forces as on approach shots, the ball undergoes more deformation and hence, receives more spin.

In further preferred embodiments, the cover inner layer and the cover outer layer each have a Shore D hardness in the range of 40 to 60; and the solid core is based on polybutadiene and undergoes a deflection of 2.5 to 5.5 mm under an applied load of 100 kg. Then the aforementioned advantages are enhanced.

BRIEF DESCRIPTION OF THE DRAWINGS

The sole FIGURE.

DETAILED DESCRIPTION OF THE INVENTION

Figure 1:
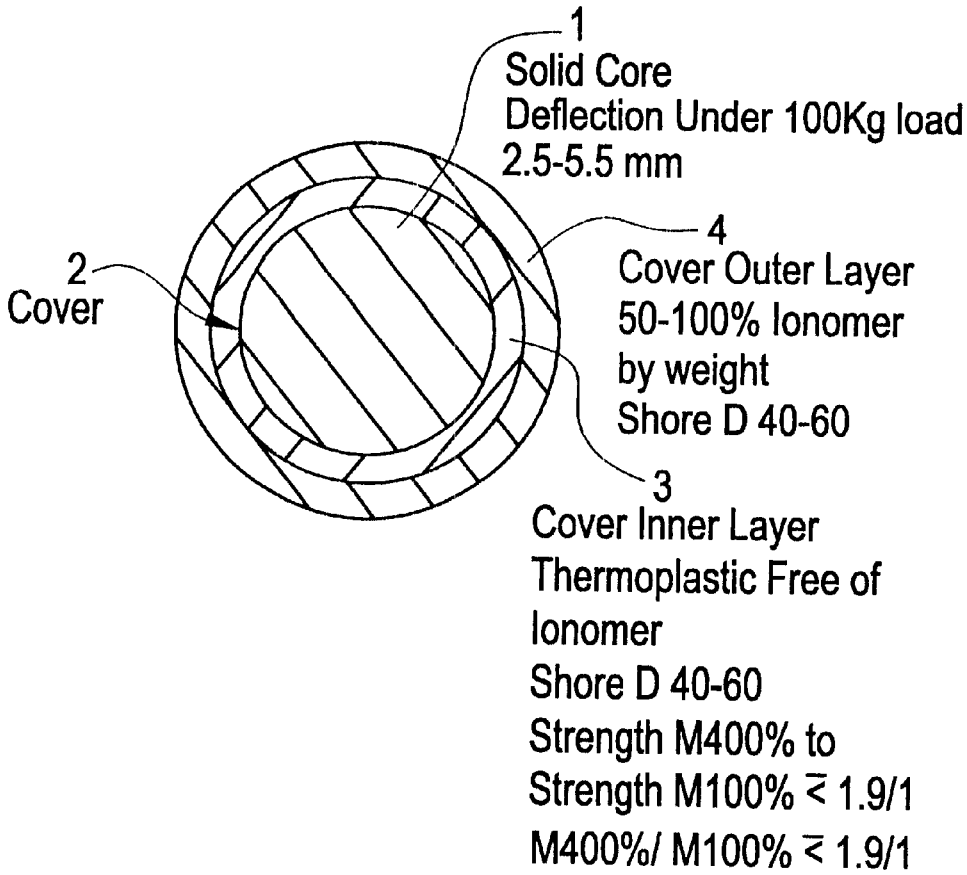
FIG. 1 is a schematic cross-sectional view of a solid golf ball according to one embodiment of the invention.

Referring to FIG. 1, the solid golf ball according to the present invention is shown as comprising a spherical solid core 1 and a cover 2 formed on the surface of the core. The cover 2 is formed to a two-layer structure consisting of a cover inner layer 3 surrounding the solid core 1 and a cover outer layer 4 surrounding the inner layer 3. The ball shown in FIG. 1 is a three-piece ball having a solid core of a single layer although the solid core can be a multilayer core consisting of two or more layers if necessary.

According to the invention, the cover inner layer, the cover outer layer and the hardness difference therebetween are optimized. Specifically, the cover inner layer 3 is composed mainly of a thermoplastic elastomer free of an ionomer resin, and the cover outer layer 4 is formed of a cover stock containing 50 to 100% by weight of an ionomer resin. The difference in Shore D hardness between the inner layer and the outer layer is within 2 Shore units.

The solid golf ball of the invention is described in further detail. Reference is first made to the embodiment wherein the ball of the invention is a three-piece ball having a single layer core. The solid core is composed mainly of a base rubber. The base rubber used herein may be any natural rubber and/or synthetic rubber used in conventional solid golf balls, although a rubber composition based on 1,4-cis-polybutadiene containing at least 40% cis structure is especially preferable in the invention. The polybutadiene may be blended with a suitable amount of natural rubber, polyisoprene rubber, styrene-butadiene rubber or the like if desired. Where the core is of multilayer structure, its center core and a core enclosure may also be formed from rubber compositions similar to the above.

The hardness of the solid core 1 is not critical although it is recommended that the solid core has a hardness corresponding to a deflection of 2.5 to 5.5 mm, more preferably 2.8 to 5.4 mm, and most preferably 3.0 to 5.3 mm, under an applied load of 100 kg. If the deflection of the solid core is outside the range, the ball would become poor in feel. The solid core is usually formed to a diameter of 33 to 41 mm, preferably 34 to 40 mm, and more preferably 35 to 40 mm.

The cover inner layer 3 is composed mainly of a thermoplastic elastomer free of an ionomer resin. The thermoplastic elastomer used as the cover inner layer is not critical and may be selected from well-known thermoplastic elastomers. For example, polyester thermoplastic elastomers, polyolefin thermoplastic elastomers, and polyurethane thermoplastic elastomers are useful. Any of commercially available thermoplastic elastomers may be used. For example, polyester thermoplastic elastomers are commercially available under the trade name of Hytrel 4001, 4767 and 5557 from Toray-DuPont K.K. and polyolefin thermoplastic elastomers under the trade name of Affinity FW1650 from Dow Chemical Co. These elastomers may be used alone or in admixture of two or more.

In forming the cover inner layer 3, various additives may be added to the thermoplastic elastomer. Such additives include inorganic fillers serving as a weight modifier, such as zinc oxide and barium sulfate and coloring agents such as titanium dioxide.

Provided that the cover inner layer has a strength M100% at a tensile elongation of 100% and a strength M400% at a tensile elongation of 400%, the ratio of M400%/M100% is preferably up to 1.9/1, more preferably from 1.1/1 to 1.8/1, and most preferably from 1.15/1 to 1.7/1. By restricting M400%/M100% to 1.9 or less, a ball is obtained which undergoes more deformation upon impacts with weaker forces as on approach shots.

It is noted that the strength at a tensile elongation is measured according to JIS K7113, the tensile test method on plastics. Main requirements are described below.

1) Conditioning of a test specimen, test temperature and humidity are as in JIS K7113
2) The tester used is Instron Model 4201 by Instron Co.
3) The micrometer for measuring the size of a specimen is as in JIS K7113.
4) The shape of a specimen corresponds to No. 2 specimen having a gage of about 1 mm.
5) The method of forming a specimen is as in JIS K7113.
6) The number of specimens is as in JIS K7113.
7) The testing speed is 500mm/min.
8) Calculation is as in JIS K7113.

Further, the cover inner;layer is preferably formed to a hardness approximately equal to that of the cover outer layer such that the difference in hardness between the cover inner layer and the cover outer layer is within 2, preferably within 1.5, more preferably within 1.2, on Shore D hardness scale. The cover inner layer itself preferably has a Shore D hardness of 40 to 60, especially 40 to 59. A Shore D hardness of less than 40 would lead to less resilience whereas a cover layer with a Shore D hardness of more than 60 would sometimes lead to a harder feel beyond the practically acceptable level. The hardness used herein is as measured by the method of ASTM 240.

The gage or radial thickness of the cover inner layer 3 may be adjusted as appropriate and is not critical although it is usually 0.5 to 5 mm, especially 0.6 to 4 mm.

The cover outer layer 4 surrounding the cover inner layer 3 is composed mainly of an ionomer resin. Specifically the outer layer is formed of a cover stock containing 50 to 100%, preferably 60 to 100%, and more preferably 70 to 100% by weight of an ionomer resin.

The ionomer resin used herein is selected from well-known ionomer resins, for example, Himilan 1605, 1706 and 1855 commercially available from Mitsui-duPont Polychemicals K.K. and Surlyn 9320 and 8120 from E. I. dupont. These ionomer resins may be used alone or in admixture of two or more. Another polymer such as the above-mentioned thermoplastic elastomer may be blended with the ionomer resin. The cover stock for the outer layer may further contain well-known additives such as pigments, dispersants, antioxidants, UV absorbers, UV stabilizers, and plasticizers.

The hardness of the cover outer layer 4 is preferably adjusted so as to meet the above-specified difference in Shore D hardness from the cover inner layer 3, that is, adjusted as appropriate in accordance with the hardness of the cover inner layer. The cover outer layer itself preferably has a Shore D hardness of 40 to 60, especially 40 to 59.

The solid golf ball of the invention may be prepared by molding and vulcanizing the above-described base rubber into a solid core, forming the cover inner layer on the core, and forming the cover outer layer thereon.

In the step of forming the solid core, a rubber composition is prepared by blending the above-described base rubber with a crosslinking agent, a co-crosslinking agent, an inert filler and optional additives while adjusting the blending ratio, then molding and vulcanizing the blend while adjusting the vulcanizing conditions. Examples of crosslinking agents include organic peroxides such as dicumyl peroxide and di-t-bupyl peroxide, with dicumyl peroxide being especially preferred. The crosslinking agent is generally added in an amount of about 0.5 to 20 parts by weight per 100 parts by weight of the base rubber. Co-crosslinking agents that can be used include, without particular limitation, metal salts of unsaturated fatty acids, and preferably zinc and magnesium salts of unsaturated fatty acids having 3 to 8 carbons (e.g., acrylic acid and methacrylic acid), of which zinc acrylate is especially preferable. The amount of co-crosslinking agent added is preferably about 15 to 40 parts, especially 18 to 38 parts by weight per 100 parts by weight of the base rubber. Suitable inert fillers include zinc oxide, barium sulfate, silica, calcium carbonate and zinc carbonate, with zinc oxide and barium sulfate being most often used. The filler is usually blended in an amount of 5 to 35 parts by weight per 100 parts by weight of the base rubber, although this amount is governed in part by the specific gravities of the core and the cover, as well as weight standards for the ball, and is not subject to any particular limits.

The solid core-forming composition obtained by combining the above components is usually worked in a conventional mixer such as a Banbury mixer or a roll mill, then compression or injection molded in a core mold. The molded part is then cured by heating at a sufficient temperature for the crosslinking agent and co-crosslinking agent to function (for example, a temperature of about 130 to 170° C. for a combination of dicumyl peroxide as the crosslinking agent and zinc acrylate as the co-crosslinking agent), obtaining a solid core.

A cover stock based on the thermoplastic elastomer, but free of an ionomer resin is then molded over the solid core by an injection molding or compression molding technique in a conventional manner, forming the cover inner layer.

A cover stock based on the ionomer resin is further molded over the cover inner layer on the solid core. The method of forming the cover outer layer is not critical. For example, the cover stock Is injection molded. Alternatively, the cover stock is preformed into a pair of hemispherical half cups, and the solid core with the cover inner layer thereon is enclosed with the half cups, which are molded under heat and pressure.

Like conventional golf balls, the golf ball of the invention is formed with a multiplicity of dimples in the cover surface. The ball may have about 300 to 600 dimples, preferably about 310 to 550 dimples. The dimples may be distributed in any desired geometrical arrangement such as octahedral and icosahedral arrangements, and the pattern of dimples may be any of square,l hexagon, pentagon, and triangle patterns.

The golf ball of the invention is prepared in accordance with the Rules of Golf, that is, to a diameter of not less than 42.67 mm and a weight of not greater than 45.93 grams.

While maintaining the superior flight performance and durability inherent to solid golf balls, the solid golf ball of the invention has spin property close to wound golf balls, that is, receives an appropriate spin on iron shots, and is improved in control and feel.

EXAMPLE

Examples of the present invention are given below by way of illustration and not by way of limitation. All parts are by weight.

Examples 1–4 & Comparative Examples 1–5

Three-piece solid golf balls were prepared by forming solid cores, cover inner layers and cover outer layers from the formulations shown in Table 1 to the parameters shown in Table 1.

More specifically, the solid cores were formed by kneading the respective components in a roll mill and press molding at 155° C. for 15 minutes. The cover inner layers were formed by injection molding, so as to enclose the outer surface of the solid cores. The cover outer layers were formed by injection molding, sofas to enclose the outer surface of the inner layers.

The golf balls thus obtained were tested for distance, spin and feel. The results are shown in Table 1.

Flight performance

Using a swing robot, the golf balls were measured for carry and total distance when hit with a driver (#W1) at a head speed of 45 m/s (HS45) and a No. 6 iron (#I6) at a head speed of 36 m/s (HS36). The driver used was a PRO 230 Titan manufactured by Bridgestone Sports Co., Ltd. (loft angle 11°, shaft Harmotech Lite HM50J(HK), hardness S, balance $D_2$). The iron used was a J's Titanium Muscle Back manufactured by Bridgestone Sports Co., Ltd.

Spin

Each golf ball was hit with #W1 (HS45), #I6 (HS36) or a sand wedge (#SW) at a head speed of 33 m/s, the behavior of the ball immediately after impact was photographed. A spin rate was computed by photographic analysis.

Feel

The balls were driven by three professional golfers with #W1, #I6, #SW and a putter (#PT), who rated each ball according to the following criteria.

S: soft

RH: rather hard

H: hard

TABLE 1

| | | | E1 | E2 | E3 | E4 | CE1 | CE2 | CE3 | CE4 | CE5 |
|---|---|---|---|---|---|---|---|---|---|---|---|
| Solid core | Formulation (pbw) | 1,4-cis-polybutadiene | 100 | 100 | 100 | 100 | 100 | 100 | 100 | 100 | 100 |
| | | Zinc acrylate | 29 | 29 | 24 | 29 | 24 | 38 | 29 | 37 | 29 |
| | | Dicumyl peroxide | 0.6 | 0.6 | 0.6 | 0.6 | 0.6 | 0.6 | 0.6 | 0.6 | 0.6 |
| | | Peptizer | 1 | 1 | 1 | 1 | 1 | 1 | 1 | 1 | 1 |
| | | Antioxidant | 0.1 | 0.1 | 0.1 | 0.1 | 0.1 | 0.1 | 0.1 | 0.1 | 0.1 |
| | | Zinc oxide | 19.5 | 17.5 | 20.7 | 26.8 | 31.5 | 30.6 | 24.3 | 18.6 | 29.1 |
| | Diameter (mm) | | 35.7 | 36.5 | 35.7 | 36.5 | 35.7 | 34.7 | 30.7 | 34.7 | 35.7 |
| | Hardness (mm) | | 3.5 | 3.5 | 4.3 | 3.5 | 4.3 | 2.3 | 3.5 | 2.5 | 3.5 |
| Cover inner layer | Formulation (pbw) | Hytrel 4001 | 100 | — | — | — | — | — | — | — | — |
| | | Hytrel 4767 | — | 100 | — | — | — | — | 100 | 100 | — |
| | | Hytrel 5557 | — | — | 100 | — | — | — | — | — | — |
| | | Affinity FW1650 | — | — | — | 90 | — | — | — | — | — |
| | | Himilan 1855 | — | — | — | — | 100 | 30 | — | — | — |
| | | Himilan 1557 | — | — | — | — | — | 20 | — | — | — |
| | | Surlyn 8120 | — | — | — | — | — | 50 | — | — | — |
| | | Himilan 1605 | — | — | — | — | — | — | — | — | 50 |
| | | Himilan 1706 | — | — | — | — | — | — | — | — | 50 |
| | | Zinc oxide | — | — | — | 10 | — | — | — | — | — |
| | Specific gravity (g/cm$^3$) | | 1.12 | 1.15 | 1.19 | 0.96 | 0.97 | 0.97 | 1.15 | 1.15 | 0.97 |
| | Gage (mm) | | 2.0 | 1.6 | 1.6 | 1.6 | 1.6 | 2.0 | 4.0 | 2.0 | 2.0 |
| | Hardness (Shore D) | | 41 | 51 | 57 | 43 | 57 | 52 | 51 | 51 | 63 |
| | M400%/M100% | | 1.4 | 1.3 | 1.4 | 1.4 | 2.0 | 2.3 | 1.3 | 1.3 | — |
| Cover outer layer | Formulation (pbw) | Surlyn 9320 | 75 | 40 | 20 | 75 | 20 | 35 | — | — | — |
| | | Himilan 1605 | 25 | 60 | 80 | 25 | 80 | 65 | 50 | — | — |
| | | Himilan 1706 | — | — | — | — | — | — | 50 | — | — |
| | | Himilan 1855 | — | — | — | — | — | — | — | 100 | 100 |
| | Gage (mm) | | 1.5 | 1.5 | 1.9 | 1.5 | 1.9 | 2.0 | 2.0 | 2.0 | 1.5 |
| | Hardness (Shore D) | | 42 | 51 | 57 | 42 | 57 | 53 | 63 | 57 | 57 |
| Golf ball | Hardness* (mm) | | 3.5 | 3.1 | 3.3 | 3.4 | 3.2 | 2.3 | 2.5 | 2.4 | 2.5 |
| | Tests | #W1/HS45 | | | | | | | | | |
| | | Spin (rpm) | 2848 | 2589 | 2456 | 2835 | 2390 | 2533 | 2421 | 2589 | 2623 |
| | | Carry (m) | 211.2 | 211.3 | 211.0 | 211.0 | 208.5 | 207.9 | 210.0 | 210.7 | 211.0 |

TABLE 1-continued

| | E1 | E2 | E3 | E4 | CE1 | CE2 | CE3 | CE4 | CE5 |
|---|---|---|---|---|---|---|---|---|---|
| Total (m) | 225.5 | 226.2 | 226.5 | 225.5 | 224.8 | 223.5 | 226.0 | 225.2 | 216.0 |
| Feel | S | S | S | S | RH | H | RH | H | H |
| #I6/HS36 | | | | | | | | | |
| Spin (rpm) | 8124 | 7238 | 6697 | 8086 | 6311 | 6593 | 5998 | 6579 | 6234 |
| Carry (m) | 160.8 | 160.5 | 160.4 | 160.3 | 157.5 | 156.9 | 158.7 | 158.5 | 158.5 |
| Total (m) | 161.7 | 162.1 | 162.5 | 161.5 | 160.3 | 159.4 | 161.7 | 160.9 | 161.0 |
| #SW/HS33 | | | | | | | | | |
| Spin (rpm) | 6910 | 6398 | 6032 | 6890 | 5813 | 6012 | 4125 | 6002 | 5805 |
| Feel | S | S | S | S | RH | S | S | H | H |
| #PT | | | | | | | | | |
| Feel | S | S | S | S | S | S | H | S | H |

*Hardness is a deflection (mm) of a core or ball under a load of 100 kg

Note that Hytrel is the trade mark for polyester thermoplastic elastomers by Toray-duPont K.K.;

Affinity is the trade mark for polyolefin thermoplastic elastomers by Dow Chemical Co.;

Himilan is the trade mark for ionomer resins by Mitsui-duPont Polychemicals K.K.; and Surlyn is the trade mark for ionomer resins by E. I. duPont.

It is evident from Table 1 that multi-piece solid golf balls of the invention are improved in spin behavior so that they will receive an appropriate spin when hit with an iron, while maintaining excellent flight performance. The balls are improved in control, durability and feel.

Although some preferred embodiments have been described, many modifications and variations may be made thereto in the light of the above teachings. It is therefore to be understood that within the scope of the appended claims, the invention may be practiced otherwise than as specifically described.

What is claimed is:

1. A solid golf ball comprising a solid core and a cover consisting of an inner layer and an outer layer, characterized in that the cover inner layer is composed mainly of a thermoplastic elastomer free of an ionomer resin, the cover outer layer contains 50 to 100% by weight of an ionomer resin, and the difference in hardness between the cover inner layer and the cover outer layer is within 2 on Shore D hardness scale.

2. The solid golf ball of claim 1 wherein the cover inner layer has a strength M100% at a tensile elongation of 100% and a strength M400% at a tensile elongation of 400% wherein the ratio of M400%/M100% is up to 1.9/1.

3. The solid golf ball of claim 1 wherein the cover inner layer and the cover outer layer each have a Shore D hardness in the range of 40 to 60.

4. The solid golf ball of claim 1 wherein the solid core is formed of a rubber composition based on polybutadiene and undergoes a deflection of 2.5 to 5.5 mm under an applied load of 100 kg.

5. The solid golf ball of claim 1, wherein said solid core has a deflection under an applied load 100 kg in the range of 3.0 to 5.3 mm.

6. The solid golf ball of claim 1, wherein said solid core has a diameter of 33 to 41 mm.

7. The solid golf ball of claim 2, wherein M400%/M100% is from 1.15/1 to 1.7/1.

8. The solid golf ball of claim 1, wherein said cover inner layer has a thickness in the range of 0.5 to 5 mm.

9. The solid golf ball of claim 1, wherein said cover inner layer has a Shore D hardness of 40 to 59.

10. The solid golf ball of claim 1, wherein said cover outer layer has a cover stock containing 70 to 100% by weight of an ionomer resin.

* * * * *